US007426965B2

(12) United States Patent
Tao et al.

(10) Patent No.: US 7,426,965 B2
(45) Date of Patent: Sep. 23, 2008

(54) POWER TRANSMISSION UNIT OF AN IMPACTOR, A HYDRAULIC JET IMPACTOR AND THE APPLICATION THEREOF

(75) Inventors: Xinghua Tao, Dezhou (CN); Guoqiang Xu, Dezhou (CN); Xutian Hou, Dezhou (CN); Yijin Zeng, Dezhou (CN)

(73) Assignees: China Petroleum & Chemical Corporation, Beijing (CN); Exploration & Production Research Institute, Sinopec, Beijing (CN)

( * ) Notice: Subject to any disclaimer, the term of this patent is extended or adjusted under 35 U.S.C. 154(b) by 182 days.

(21) Appl. No.: 10/487,303

(22) PCT Filed: Jan. 14, 2003

(86) PCT No.: PCT/CN03/00027

§ 371 (c)(1),
(2), (4) Date: Oct. 22, 2004

(87) PCT Pub. No.: WO03/058023

PCT Pub. Date: Jul. 17, 2003

(65) Prior Publication Data

US 2006/0011362 A1 Jan. 19, 2006

(30) Foreign Application Priority Data

Jan. 14, 2002 (CN) ..... 02200714
Jan. 14, 2002 (CN) ..... 02200716

(51) Int. Cl.
*E21B 5/00* (2006.01)
*E21C 7/00* (2006.01)

(52) U.S. Cl. ..... 173/17; 173/13; 173/14; 173/16; 173/78; 175/296; 175/92

(58) Field of Classification Search ..... 173/13, 173/14, 16, 17, 200, 218, 15, 78, 59, 73–74, 173/79; 175/92, 296, 293, 297; 137/596
See application file for complete search history.

(56) References Cited

U.S. PATENT DOCUMENTS 3,045,768 A * 7/1962 Huffman ..... 175/100

(Continued)

FOREIGN PATENT DOCUMENTS

CN 2040529 U 7/1989

(Continued)

*Primary Examiner*—Brian D. Nash
(74) *Attorney, Agent, or Firm*—Dickstein Shapiro LLP

(57) ABSTRACT

The invention discloses a fluid-driven impactor, a power transmission mechanism for the impactor and the use of the impactor. In the prior art, the working life of the impactor is short, since a rubber primary seal and an upper fluid-diverging lid for the fluid-driven impactor are both liable to erosion and the efficiency in transmitting power is low due to the complexity of the power transmission mechanism. In order to increase the drilling speed and/or extend the life of the impactor, the side cavity passage is formed in such a way that the inner wall of the outer pipe is isolated from the side cavity passage in a watertight manner without the use of the rubber primary seal. The loss in transmitting power is minimized by integrating the anvil of the power transmission mechanism and the lower joint. The problem of abrasion of the fluid-diverging hole is overcome and the nozzle can be used with different fluid flow by mounting a replaceable nozzle in the upper fluid-diverging lid, the nozzle selected from a series of nozzles with various inner diameters and made of a material more wearable than the material for diverging lid the upper fluid.

26 Claims, 3 Drawing Sheets

U.S. PATENT DOCUMENTS

| | | | | | |
|---|---|---|---|---|---|
| 3,795,283 | A | * | 3/1974 | Oughton | 173/73 |
| 3,896,886 | A | * | 7/1975 | Roscoe, Jr. | 173/17 |
| 3,899,033 | A | * | 8/1975 | Van Huisen | 175/97 |
| 3,924,690 | A | * | 12/1975 | Shaw | 173/13 |
| 4,084,646 | A | * | 4/1978 | Kurt | 173/17 |
| 4,100,980 | A | * | 7/1978 | Jenne | 175/19 |
| 4,165,788 | A | * | 8/1979 | Montabert | 173/17 |
| 4,383,581 | A | * | 5/1983 | Shalashov et al. | 173/16 |
| 4,790,390 | A | * | 12/1988 | Sweeny | 173/17 |
| 4,819,746 | A | * | 4/1989 | Brown et al. | 175/296 |
| 4,821,812 | A | * | 4/1989 | Ditzig | 173/17 |
| 5,086,852 | A | * | 2/1992 | van Buskirk | 175/269 |
| 5,293,946 | A | * | 3/1994 | Besson et al. | 175/424 |
| 5,322,136 | A | * | 6/1994 | Bui et al. | 175/65 |
| 5,494,124 | A | * | 2/1996 | Dove et al. | 175/424 |
| 5,785,258 | A | * | 7/1998 | Akin et al. | 239/590 |
| 5,816,342 | A | * | 10/1998 | Prater et al. | 173/91 |
| 5,944,117 | A | * | 8/1999 | Burkholder et al. | 173/91 |
| 6,237,704 | B1 | * | 5/2001 | Lay | 175/296 |
| 6,273,201 | B1 | | 8/2001 | Randa et al. | |
| 2004/0140131 | A1 | * | 7/2004 | Susman | 175/296 |

FOREIGN PATENT DOCUMENTS

| | | | |
|---|---|---|---|
| CN | 2385068 | Y | 6/2000 |
| CN | 2479178 | Y | 2/2002 |
| CN | 2480534 | Y | 3/2002 |
| EP | 1 004 744 | A2 | 5/2000 |
| JP | 8-193483 | | 7/1996 |
| SU | 927947 | | 5/1992 |
| WO | WO 2003/058023 | A1 | 7/2003 |

* cited by examiner

A' – A'

B' – B'

POWER TRANSMISSION UNIT OF AN IMPACTOR, A HYDRAULIC JET IMPACTOR AND THE APPLICATION THEREOF

CROSS-REFERENCE TO RELATED APPLICATIONS

This application is a U.S. National Phase of PCT Application No. PCT/CN03/00027 filed Jan. 14, 2003, which claims priority to Chinese Application Numbers 02200714.8 and 02200716.4 filed on Jan. 14, 2002.

TECHNICAL FIELD

The present invention relates in general to a rotary-impacting drilling tool, and more particularly, to a power transmission mechanism, a fluid-driven impactor and its use.

TECHNICAL BACKGROUND

A fluid-driven impactor is one of BHA (Bottom Hole Assembly) tools powered downhole in rotary drilling processes and rotary-impacting drilling is a new process with respect to the prior art. The operation principle of the rotary-impacting drilling is as follows: a fluid-driven impactor is provided at the top of a bit or a core barrel. During the drilling, the bit rotates along with a drill string under a given bit pressure. In the meantime, the drilling bit is subjected to high frequency impacts from the impactor, such that the rock is broken under the joint action of the rotary motion and the impact motion so as to substantially increase the drilling penetration rate.

In CN 2385068Y is disclosed a fluid-driven impactor which, as shown in FIG. 1, comprises: an upper joint 1; an outer sleeve 2 connected to a lower threaded portion of the upper joint I at its upper end; a middle joint 3 connected to a lower threaded portion of the outer sleeve 2 at its upper end and provided with a central passage; an outer pipe 4 connected with a lower end of the middle joint 3 via thread; an inner-prismy sleeve 5 having an inner hole with a polygonal profile and connected to a lower threaded portion of the outer pipe 4 and provided with a central passage; an anvil 6 mounted inside the sleeve 5 and provided with outer threads at the lower end thereof; a lower joint 7, having, at the upper end thereof, a hole with an inner thread to which is connected the lower end of the anvil 6, and having, at the lower end thereof, a threaded hole for mounting tools such as drilling bit. In the impactor, the central passage of the middle joint is in communication with an inner cavity of the outer pipe. An upper fluid-diverging lid 8 with a central hole and a plurality of fluid-diverging holes, a jet element 9 with a plurality of outlet holes 90, a cylinder 10 with an inner cavity, a piston 11 mounted in the inner cavity of the cylinder 10, a piston rod 12 connected to the piston 11, a lower cylinder lid 13 mounted at the bottom end of the cylinder 10 and provided with a central hole for passing the piston rod 12 and an impacting hammer 14 connected to the piston rod 12 and having impacting action on the top of the anvil 6 are in sequence mounted in the outer sleeve 2, the middle joint 3 and the outer pipe 4. The fluid undesired for the impacting operation will be drained out through the fluid-diverging holes in the upper fluid-diverging lid 8 so as to join in the drilling circulation. The inner cavity of the cylinder 10 is divided into an upper cavity 15 and a lower cavity 16. One of these outlet holes of the jet element 9 is in communication with the lower cavity 16 by means of a side cavity passage 17. The inner wall of the outer sleeve 2 and the outer wall of the cylinder 10 define the borders for the side cavity passage 17. In other words, the side cavity passage 17 is formed between the inner wall of the outer sleeve 2 and the outer wall of the cylinder 10 in such a way that a slot with a C-shaped cross section is made in the outer wall of the cylinder 10, the slot opening to the inner wall of the outer sleeve. The description of the jet element 9 is omitted for clarity, since it is known in the art and has been described for example in CN 2385068Y.

The operation of the fluid-driven impactor is described as follows:

The working fluid from the central hole of the upper fluid-diverging lid 8 enters the upper cavity 15 and lower cavity 16 through the jet element 9 and its outlet holes. The piston 11 and further the piston rod 12 and the impacting hammer 14 reciprocate inside the cavities under the pressure difference between the upper cavity 15 and lower cavity 16, in order to transmit the impacting force to the top of the anvil 6, the lower joint and thereby the drilling bit. In the meantime, the torque from the drilling string is transmitted to the anvil 6, then to the lower joint 7 and the drilling bit through the inner-prismy sleeve 5, thereby enabling a drilling member such as a drilling bit connected to the lower joint to drill forward under the action of the rotary force and impacting force. Such a fluid-driven impactor can substantially improve drilling efficiency and meanwhile reduce the drilling cost. Generally, the power transmission mechanism of the impactor comprises the anvil, the inner-prismy sleeve and the lower joint.

However, there are some disadvantages with the fluid-driven impactor and its power transmission mechanism disclosed in CN 2385068Y.

First, the abrasive members in the fluid-driven impactor need to be replaced due to the abrasion, which shortens the working life of the fluid-driven impactor. There are two abrasive members: the fluid-diverging holes in the upper fluid-diverging lid and the O-shaped rubber seal ring located between the outer surface of the cylinder and the inner wall of the outer sleeve. The O-shaped rubber seal ring is used for sealing the side cavity passage to allow the fluid from the jet element to enter the lower cavity of the cylinder. The O-shaped seal ring is referred as the primary seal, whose working life, in practice, is less than 30 hours and therefore the working life of the fluid-driven impactor is less than 30 hours.

The reason why the rubber seal ring (the primary seal) is liable to abrasion is that the flow rate of the drilling fluid passing by the seal ring is very high and the shapes of various components are irregular, which causes swirl or vortex to directly flush the seal ring abrasively. Moreover, the primary seal prematurely degrades or damages due to the high temperature and pressure of the corrosive downhole drilling fluid and due to flush and corrosion of the main internal parts. In addition, the reason why the fluid-diverging hole is liable to abrasion is that the upper fluid-diverging lid is made generally of a structural steel alloy with a relatively low hardness as HRC of 28 to 32, for example 40Cr and 35CrMo. Therefore, the high-speed fluid easily flushes the holes abrasively. In general, the working life of the fluid-diverging hole is about 30 hours.

Second, the fluid-driven impactor does not increase the drilling speed significantly, since when the impacting power is transmitted to the bit, 60% of the impacting power is lost, that is, only 40% is applied to the drilling bit. Therefore, the working efficiency for drilling in both impacting and rotary way is greatly reduced.

Finally, the upper fluid-diverging lid has to be often replaced, because the fluid-diverging holes as described above are liable to abrasion, and the size of the fluid-diverging holes are fixed, such that for handling different flow of fluid, the fluid diverging holes need to be re-processed to have different sizes, or a series of upper fluid-diverging lids having fluid diverging holes of varying sizes must be prepared. Therefore, the cost for maintaining the upper fluid-diverging lids is increased yet the efficiency is not improved.

The above disadvantages can severely affect and restrain the working life and efficiency of the fluid-driven impactor, and thereby affect broad applications of the rotary-impacting drilling technique and the economic and technological benefits.

SUMMARY OF THE INVENTION

One object of the present invention is to provide a fluid-driven impactor that overcomes the disadvantage of prior art such as short working life of the impactor and thereby improves the efficiency thereof.

Another object of the present invention is to provide a power transmission mechanism for the fluid-driven impactor with a higher impacting energy-transmitting efficiency.

A further object of the present invention is to provide a fluid-driven impactor that can improve the impacting energy efficiency and thereby increase the drilling speed and working efficiency by improving a power transmission mechanism.

A further object of the present invention is to provide a fluid-driven impactor in which the cost of the upper fluid-diverging lids is reduced and working efficiency is improved since the whole upper fluid-diverging lids need not to be replaced.

The final object of the present invention is to apply the fluid-driven impactor according to this invention to drilling of rigid and fragile formation.

According to one aspect of the present invention, there is provided a fluid-driven impactor comprising: an outer sleeve; a jet element mounted inside the outer sleeve and having a plurality of outlet holes; a cylinder mounted inside the outer sleeve and having an inner cavity; an upper fluid-diverging lid with a plurality of fluid-diverging holes; a piston located inside the inner cavity of the cylinder, which divides the inner cavity into an upper cavity and a lower cavity; a piston rod connected to the piston; a lower cylinder lid with a hole at the center thereof; an impacting hammer connected with the piston rod; and a power transmission mechanism. In the fluid-driven impactor, the cylinder is provided in its outer wall with a side cavity passage by means of which one of outlet holes of the jet element is in communication with the lower cavity. The side cavity passage is formed on the outer wall of the cylinder in such a way that the side cavity passage is isolated from an inner wall surface of the outer sleeve in a watertight way.

This embodiment changes the configuration of the side cavity passage of the fluid-driven impactor and thereby avoids using a rubber primmay seal such that the premature malfunction of the seal for the impactor is thoroughly overcome and drilling speed and efficiency are improved, so that the single working life of the impactor is prolonged by over twice.

According to another embodiment of the present invention, the side cavity passage is formed on the outer wall of the cylinder in such a way that a substantially C-shaped groove is formed on the outer wall of the cylinder and is covered by an arcuate metal piece welded from outside, the metal piece matching the outline of the edge of the groove. Alternatively, the side cavity passage is formed by molding in the outer wall such that the outer wall of the cylinder acts as an interface of the side cavity passage.

According to other embodiments of the present invention, a metal gasket for axially pressing the seal is provided between the jet element and the upper fluid-diverging lid of the cylinder and/or a copper sleeve closely surrounding the piston rod is set in the central hole of the lower cylinder lid.

According to a further embodiment of the present invention, the fluid-driven impactor contains a power transmission mechanism comprising: an inner-prismy sleeve with an inner hole having a polygonal profile, mounted inside an outer pipe by connecting the male thread on the upper end of the inner-prismy sleeve with the female thread at the lower end of the outer pipe; an outer-prismy anvil mounted slidably in the inner hole of the inner-prismy sleeve; In the fluid-driven impactor more than one fluid passages are provided at the top surface of the outer-prismy anvil so that the fluid passages are in communication with a hollow passage inside the outer-prismy anvil and a hole is formed with a female thread for matching with a male thread of a tool, in other words, the hole is in communication with the hollow passage so that the drilling fluid can pass through said fluid passages and the hollow passage to the tool mounted in the hole.

According to a further embodiment of the present invention, a nozzle is replaceably mounted in one of fluid-diverging holes in the upper f id-diverging lid and the nozzle is selected from a series of nozzles with various inner diameters and made of a steel alloy whose HRC is at least twice that of the upper fluid-diverging lid.

Preferably, the nozzle is mounted in the fluid-diverging hole by means of a clip and an outlet inner diameter H of the nozzle and an inlet inner diameter L are designed as follows: $0<H\leqq L$.

According to the second aspect of the present invention, there is provided a power transmission mechanism for a fluid-driven impactor, comprising: An inner-prismy sleeve with an inner hole having a polygonal profile, mounted inside an outer pipe by connecting the upper end of the inner-prismy sleeve with the outer pipe; An outer-prismy anvil mounted slidably in the inner hole of the inner-prismy sleeve. In the fluid-driven impactor, more than one fluid passages are provided at the top surface of the outer-prismy anvil so that the fluid passages are in communication with a hollow passage inside the outer-prismy anvil at the lower end thereof, and a hole is formed with a female thread for matching with a male thread of a tool, in other words, the hole is in communication with the hollow passage so that the drilling fluid can pass through said fluid passages and the hollow passage to the tool mounted in the hole. According to this embodiment, the efficiency in transmitting power is enhanced 20% because one thread interface is omitted when the anvil and the lower joint are integrated together and another 20% because the transmitting distance is shortened due to the shortening of the inner-prismy sleeve. Therefore the efficiency for power transmission is enhanced 40% as compared with the conventional structure.

In addition, preferably, the top end of the outer-prismy anvil has a circular truncated conical form, and an upper part of the anvil with its outer surface adjacent to the top end has a hollow cylindrical form, and a lower part of the anvil is of a hollow body with an outer polygonal profile for engaging with the inner hole of the inner-prismy sleeve, and the hole is provided in a cylindrical lowermost part of the anvil. Moreover, the upper end of the inner-prismy sleeve is in threaded connection with the outer pipe.

According to a further embodiment, in the above fluid-driven impactor, an open sleeve consisting of two semi circular pieces is provided on the upper part of the outer-prismy anvil with is engaged with the outer pipe with a clearance. In addition, the cross section of lower part of the outer-prismy anvil and the cross section of the inner-prismy sleeve are preferably of n orthodox-polygon, wherein n is from 3 to 10, preferably 8.

Moreover, a ratio of the length of the inner hole of the inner-prismy sleeve to the diameter of the circumcircle of the polygon in cross section of the inner-prismy sleeve is from 0.7 to 1.1, preferably from 0.8 to 1.0.

Moreover, the conical uppermost part of the outer-prismy anvil (6) has a slop of 25°-75°, preferably from 45° to 75°. In addition, there are four fluid passages provided in the anvil.

According to another embodiment of the present invention, an idle-running prevention mechanism is made in the fluid-driven mechanism in such a way that a horizontal annular space is provided between the inner-prismy sleeve and the open sleeve, that is, the axial displacement of the outer-prismy anvil is controlled by the inner-prismy sleeve so that the tool and the outer-prismy anvil automatically slide down and thereby the impacting hammer slides down to stop the power supply and to prevent the impacting hammer from impacting the outer-prismy anvil during idle operation.

According to the third aspect of the present invention, there is provided a fluid-driven impactor, comprising: an outer sleeve; a jet element mounted inside the outer sleeve and having a plurality of outlet holes; a cylinder mounted inside the outer sleeve and having an inner cavity; an upper fluid-diverging lid with a plurality of fluid-diverging holes; a piston located inside an inner cavity of the cylinder, which divides the inner cavity into an upper cavity and a lower cavity; a piston rod connected to the piston; a lower cylinder lid with a hole at the center thereof, an impacting hammer connected with the piston rod; and a power transmission mechanism; wherein the cylinder is provided with a side cavity passage in its outer wall, the side cavity passage allowing one of outlet holes of the jet element to be in communication with the lower cavity. In the impactor, a nozzle is removably mounted in one of fluid-diverging holes in the upper fluid-diverging lid, and the nozzle is selected from a series of nozzles with various inner diameters and made of a steel alloy whose HRC is at least twice that of the upper fluid-diverging lid. According to this embodiment, the working life of the fluid-diverging holes is prolonged and the nozzle can be replaced depending on different flow.

In addition, the nozzle is mounted in the fluid-diverging hole by means of a clipor a pin and an outlet inner diameter H of the nozzle and an inlet inner diameter L are designed as follows: $0<H\leqq L$.

According to the forth aspect of the present invention, there is provide a fluid-driven impactor, comprising: an outer sleeve; a jet element mounted inside the outer sleeve and having a plurality of outlet holes; a cylinder mounted inside the outer sleeve and having an inner cavity; an upper fluid-diverging lid with a plurality of fluid-diverging holes; a piston located inside an inner cavity of the cylinder, which divides the inner cavity of the cylinder into an upper cavity and a lower cavity; a piston rod connected to the piston; a lower cylinder lid with a hole at the center thereof; an impacting hammer connected with the piston rod; and a power transmission mechanism; wherein the cylinder is provided with a side cavity passage in its outer wall, the side cavity passage allowing one of outlet holes of the jet element to be in communication with the lower cavity; wherein the power transmission mechanism is one of those defined by the second aspect of this invention. According to this embodiment, the efficiency for power transmission is enhanced significantly.

In other embodiment, a nozzle is removably mounted in one of fluid-diverging holes in the upper fluid-diverging lid and the nozzle is selected from a series of nozzles with various inner diameter and made of a steel alloy whose HRC is at least twice that of the upper fluid-diverging lid.

Preferably, the nozzle is mounted in the fluid-diverging hole by means of a clipor a pin and an outlet inner diameter H of the nozzle and an inlet inner diameter L are designed as follows: $0<H\leqq L$.

According to the fifth aspect of the present invention, this application is directed at the use of the fluid-driven impactor described in the first, second, third and forth aspects of the present invention for drilling the rigid and fragile formation which has a rigidity of above 5, a compressive strength of 150 MPa and a rock drillability of above 5.

BRIEF DESCRIPTION OF DRAWINGS

Now the embodiments will be described with reference to the appended drawings in which.

BEST MODE FOR CARRYING OUT THE INVENTION

Figure 1:
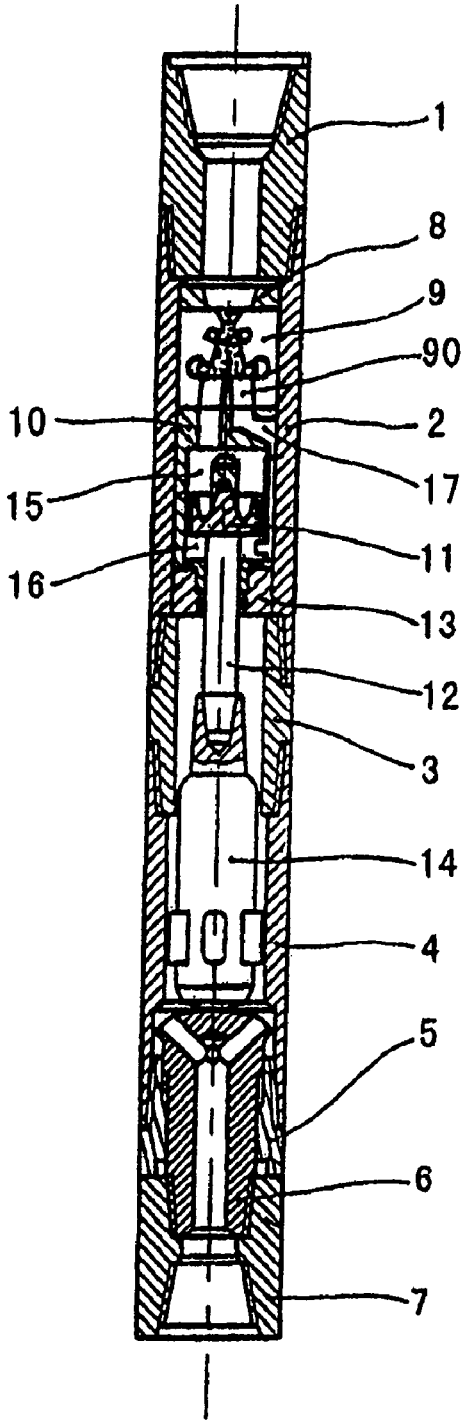
FIG. 1 Prior Art
FIG. 1 is a cross section view of the fluid-driven impactor according to the prior art.

Reference will now be made in detail to the accompanying drawings to describe the preferred embodiments of the present invention. In describing the embodiments of the present invention, member or parts having the same functions as in the prior art as shown in FIG. 1 will be given the same reference numbers, and will not be described herein.

In order to provide a fluid-driven impactor without the disadvantage of short life, the improvement is made to the primary seal for the fluid-driven impactor according to one aspect of the present invention. In all aspects, the fluid-driven impactor is identical with that disclosed in CN2385068Y in terms of structure or feature or includes the improved technical features or structures of the present invention illustrated below. Therefore only members or parts related to the primary seal will be illustrated for the fluid driven impactor according to the first aspect of the present invention.

According to the first aspect of the present invention, there is provided a fluid-driven impactor comprising: an outer sleeve 2; a jet element 9 with a plurality of outlet holes 90; a cylinder 10; an upper fluid-diverging lid 8; a piston 11 located inside the inner cavity of the cylinder 10; a piston rod 12; a lower cylinder lid 13 with a hole at the center thereof; an impacting hammer 14; a power transmission mechanism; wherein the piston divides the inner cavity of the cylinder into an upper cavity 15 and a lower cavity 16; the cylinder 10 is provided with a side cavity passage 17 in part of its outer wall, the side cavity passage 17 brings one of outlet holes 90 of the jet element 9 into fluid communication with the lower cavity 16. In this embodiment, the side cavity passage 17 is formed on the outer wall of the cylinder 10 in such a way that a substantially C-shaped groove is formed on the outer wall of the cylinder 10 but the groove is closed to the inner wall surface of the outer sleeve, that is, the side cavity passage is sealingly isolated from the inner wall surface of the outer sleeve 2. Therefore, the fluid in the side cavity passage 17 cannot contact with the inner wall of the outer sleeve.

The seal 25 is formed in such a way that an arc-shaped metal piece with a matching contour is welded onto the C-shaped groove, so that a side cavity passage in form of an axial passage is formed in the inner wall of the outer sleeve. In contrast to the solutions disclosed in CN2385068Y in which there are O-shaped rubber seal rings between the inner wall of the outer sleeve 2 and the outer wall of the cylinder 10, the problem of the premature degradation or damage due to direct erosion of the swirl or vortex produced by the excessively high flow speed of drilling fluid is overcome. Moreover, the life of the fluid-driven jet-type impactor is greatly extended since the metal material for the primary seal is more wearable than the rubber seal. According to the experiment, the working life of the fluid-driven impactor can reach 70-80 hours for single application.

Of course, the formation and structure of the side cavity passage 17 may not be limited to this. According one embodiment, the side cavity passage 17 is formed in the outer wall by molding process, that is, the outer wall of the cylinder 10 acts as an interface of the side cavity passage 17. Therefore, the embodiment allows advantageously the side cavity passage 17 to be easily manufacture and thereby the cost to be reduced.

Figure 2:
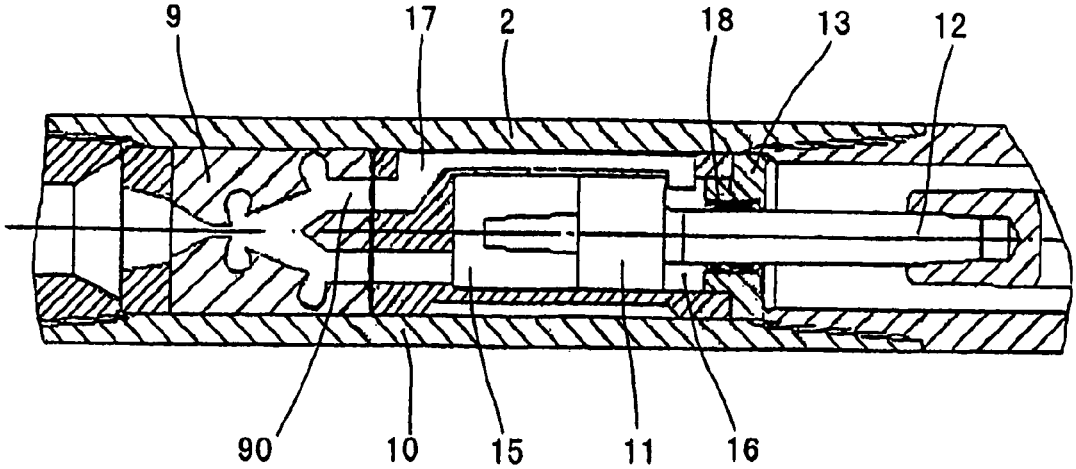
FIG. 2 is a cross section view of the fluid-driven impactor according to the present invention with the area of the primary seal shown.
Figure 3:
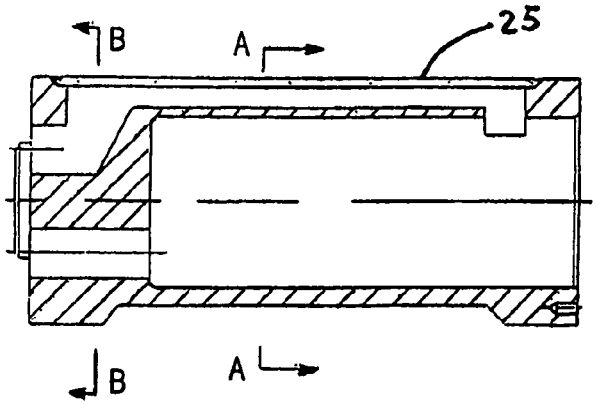
FIG. 3 is a cross section view of the cylinder and the side cavity passage shown in FIG. 2.
Figure 4:
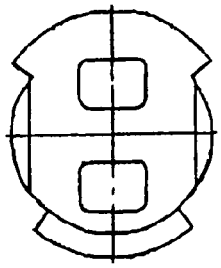
FIG. 4 is a left view of the cylinder as shown in FIG. 2.
Figure 5:
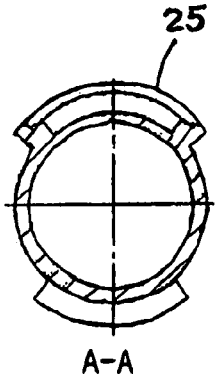
FIG. 5 is a cross section view taken along A-A line shown in FIG. 3.
Figure 6:
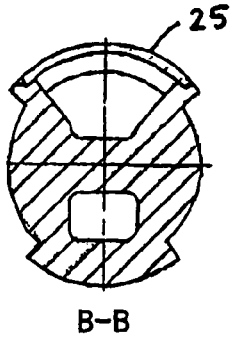
FIG. 6 is a cross section view taken along B-B line shown in FIG. 3.
Figure 7:
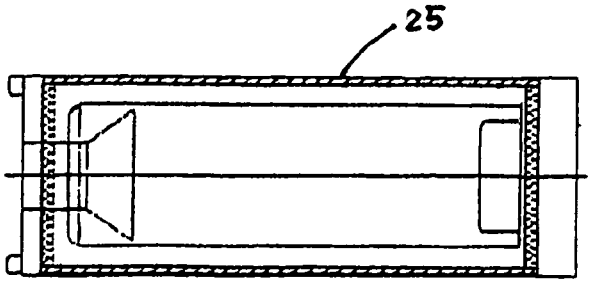
FIG. 7 schematically shows the metal welding sealing structure of the side cavity passage of FIG. 1.
Figure 8:
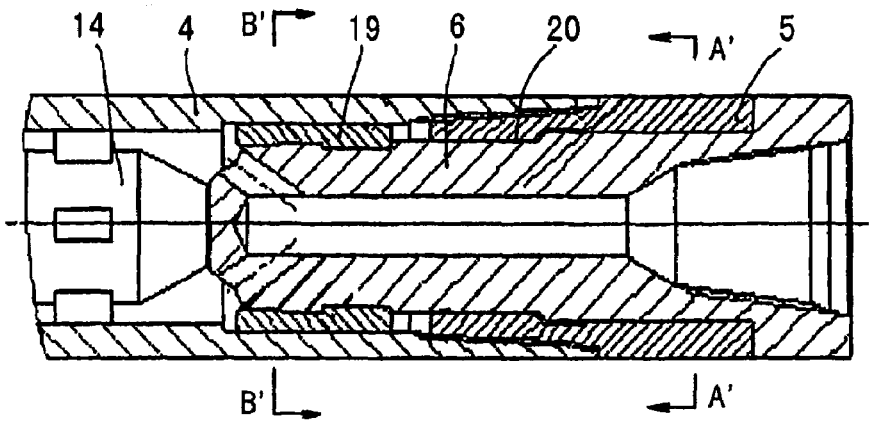
FIG. 8 shows a section view of the power transmission mechanism according to the present invention.
Figure 9:
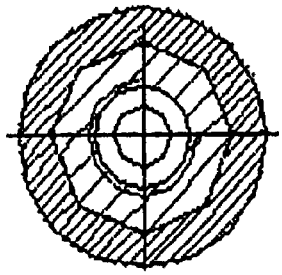
FIG. 9 is a cross section view taken along A'-A' line shown in FIG. 8.
Figure 10:
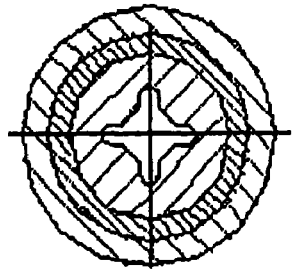
FIG. 10 is a cross section view taken along B'-B' line shown in FIG. 8.

According to other aspects of the present invention, as shown in FIG. 2, in addition to the improvements in the primary seal, a metal gasket for axial seal is provided between the jet element 9 and the upper fluid-diverging lid of the cylinder 10, the metal gasket having a smooth surface. According to another embodiment, a copper sleeve 18 tightly surrounding the piston rod 12 is set in the central hole of the lower cylinder lid 13. When the piston rod moves up and down and bring the impacting hammer into impacting movement, the copper sleeve is sealingly engages with the piston so as to prevent the drilling fluid from leaking along the piston rod which may flush and erode the impacting hammer.

According to the second aspect, a power transmission mechanism 200 for improving the impacting energy-transmitting efficiency, comprising: an inner-prismy sleeve 5 with an inner hole having a polygonal profile, mounted inside an outer pipe 4 by connecting the upper end of the inner-prismy sleeve 5 with the outer pipe 4; an outer-prismy anvil 6 with an outer polygonal profile, mounted slidably in the inner hole of the inner-prismy sleeve 5; more than one fluid passages are provided at the top surface of the outer-prismy anvil 6 so that the fluid passages are in communication with a hollow passage inside the outer-prismy anvil 6 and a hole is formed at the lower end of the anvil 6 with a female thread for matching with a male thread of a tool such as bit or coring barrel, in other words, the hole is in fluid communication with the hollow passage so that the drilling fluid can pass through said fluid passages and the hollow passage to the tool in the hole.

According to the wave transmitting theory, the impacting wave reflects on the interfaces and lost the power of about 20%. Moreover the attenuation of the impactor wave is substantially proportional to the transmitting distance. In order to improve the power transmission efficiency, taking into account the reduction of the number of transmitting members and the transmitting distance, the present inventor makes great improvement that the anvil and the lower joint in the prior art are integrated together and that the inner-prismy sleeve is correspondingly shortened according to the wave transmitting theory. Therefore, the efficiency in transmitting power is enhanced by 20% because the impacting wave passes in the present invention one thread interface less than that in the prior art when the anvil and the lower joint are integrated together and another about 20% because the transmitting distance is shortened due to the shortening of the inner-prismy sleeve. Therefore the efficiency in transmitting power is enhanced by over 40% in total as compared with the original structure.

Figure 12:
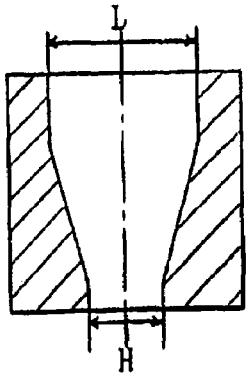
FIG. 12 shows a section view of a single nozzle.
Figure 11:
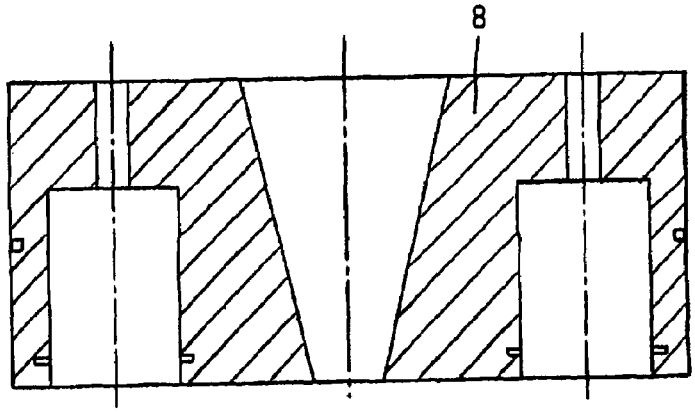
FIG. 11 shows a section view of the upper fluid-diverging lid.
Figure 13:
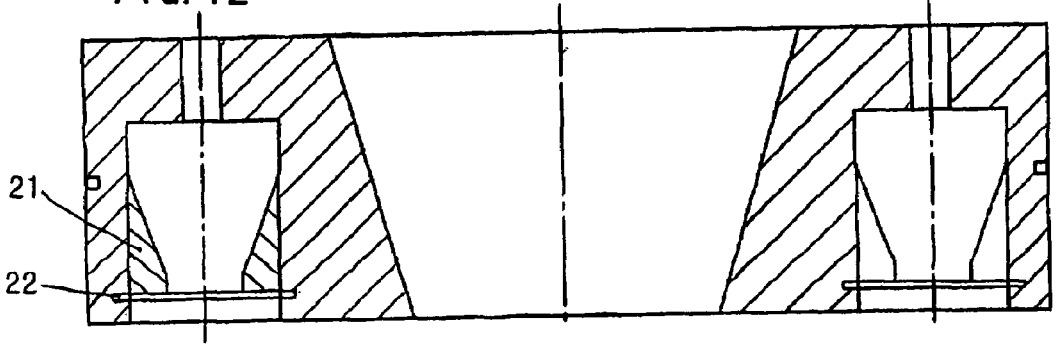
FIG. 13 shows the view of the upper fluid-diverging lid with a nozzle mounted.

In order to provide a fluid-driven impactor in which the whole upper fluid-diverging lid needs not to be replaced to reduce the operation cost of the impactor and enhance the working efficiency, according to the third aspect of the present invention, there is provided a fluid-driven impactor as shown in FIGS. 11-13, comprising: an outer sleeve 2; a jet element 9 with a plurality of outlet holes 90; a cylinder 10; an upper fluid-diverging lid 8; a piston 11 located inside the inner cavity of the cylinder 10; a piston rod 12; a lower cylinder lid 13 with a hole at the center thereof; an impacting hammer 14; and a power transmission mechanism 200, wherein, a nozzle 21 is removably mounted in one of fluid-diverging holes in the upper fluid-diverging lid 8 and the nozzle 21 is selected a series of nozzles with various inner diameters and made of a steel alloy with HRC>60 such as YG8, YG11, whose HRC is at least twice that of the upper fluid-diverging lid 8 so that the nozzle then is more anti-abrasive than the upper fluid diverging lid. An outlet inner diameter H and an inlet inner diameter L of the nozzle 21 are designed as follows: $0<H\leqq L$.

According to the different fluid flow, the nozzles with different inner diameters can be mounted in the fluid-diverging holes of the same upper fluid-diverging lid 8 as desired. There is no limitation on the way to fix the nozzles in the fluid-diverging holes, as long as the nozzle can be easily removed and replaced. For example, the nozzle 21 is mounted in the fluid-diverging hole by means of a clip 22 or a pin. The use of replaceable nozzle extends the life of the fluid-diverging holes by reducing the abrasion to the holes. In addition, the nozzles can be replaced easily to adapt to different fluid flow.

In addition, according to the forth aspect of the present invention, there is provided a fluid-driven impactor for improving the impacting energy-transmitting efficiency and thereby improving the drilling speed by means of an improved power transmission mechanism, the impactor comprising: an outer sleeve 2; a jet element 9 with a plurality of outlet holes 90; a cylinder 10; an upper fluid-diverging lid 8; a piston 11 located inside the inner cavity of the cylinder 10; a piston rod 12; a lower cylinder lid 13 with a hole at the center thereof, an impacting hammer 14; and a power transmission mechanism 200. The power transmission mechanism comprising: an inner-prismy sleeve 5 with an inner hole having a polygonal profile, mounted inside an outer pipe 4 by connecting a male thread at the upper end of the inner-prismy sleeve 5 with a female thread at the lower end of the outer pipe 4; and an outer-prismy anvil 6 mounted slidably in the inner hole of the inner-prismy sleeve 5; In the power transmission mechanism, more than one fluid passage are provided on the top surface of the outer-prismy anvil 6, so that the fluid passages are in communication with a hollow passage inside the outer-prismy anvil 6. A hole is formed at the lower end of the anvil 6 with a female thread for matching with a male thread of a tool, in other words, the hole is in fluid communication with the hollow passage so that the drilling fluid can pass through said fluid passages and the hollow passage to the tool in the hole. Compared to the power transmission mechanism disclosed in CN2385068Y, the loss in power transmission is reduced and efficiency is increased by omitting the use of the lower joint.

In addition, in the second aspect and/or the forth aspect, with use of integration of the anvil and the lower joint, a new measure is taken according to another embodiment: an open sleeve 19 consisting of two semicircular clipping pieces is stuck at the top of the anvil 6 with a clearance from the outer pipe 4. The operation of the open sleeve 19 is as follows: the impacting hammer 14 thrusts down anvil 6 to transmit the impacting force wave to such tools as the drilling bit. The inner-prismy sleeve 5 facilities the transmitting of the torque during the drilling. When the drilling bit is lifted off the bottom of the well bore, since the inner-prismy sleeve 5 limits the axial displacement of anvil 6, the drilling bit and the anvil 6 slide down freely until the open sleeve 19 reposes on the top end surface therewith of the inner-prismy sleeve 5. In turn, the piston 11 and the impacting hammer 14 slide downs to stop the run of power mechanism in order to avoid the idle running of the anvil. The open sleeve 19 facilities the fixing, protection, avoiding the idle running and prevent the outer pipe 4 from damage and deformation.

In addition, similar to those disclosed in CN 2385068Y, the top end of the anvil 6 has a circular truncated conical shape or other shapes such as mushroom head with four fluid passages in communication with a hollow passage in the anvil. On the other hand, a rubber sealing ring 20 is mounted between the anvil and the inner-prismy sleeve 5.

Moreover, an upper part of the outer-prismy anvil adjacent to the top end is a hollow cylindrical body. A middle and lower part of the anvil is a prismy body for engaging with an inner hole of the inner-prismy sleeve 5. A lowermost part of the anvil is a hollow cylindrical body with a hole. According to another embodiment, the cross section of lower part of the outer-prismy anvil 6 and the cross section of the inner-prismy sleeve 5 are preferably of n orthodox-polygon, wherein n is from 3 to 10, preferably 8.

Moreover, a ratio of the length of the inner hole of the inner-prismy sleeve to the diameter of the circumcircle of the polygon in cross section of the inner-prismy sleeve is from 0.7 to 1.1, preferably from 0.8 to 1.0. The conical uppermost part of the outer-prismy anvil (6) has a slop of 25°-75°, preferably 45°-75°.

Although the four aspects of the present invention have been described with reference to the drawings, it will be apparent to those skilled in the art that various modifications and combinations can be made in the fluid-driven impactor of the present invention without departing from the spirit or scope of the invention.

For example, according to one embodiment of the present invention, there is provided a fluid-driven impactor, comprising: an outer sleeve 2; a jet element 9 with a plurality of outlet holes 90; a cylinder 10; an upper fluid-diverging lid 8; a piston 11 located inside an inner cavity of the cylinder 10, which divides the inner cavity of the cylinder 10 into two cavities, an upper cavity 15 and a lower cavity 16; a piston rod 12; a lower cylinder lid 13 with a hole at the center thereof; an impacting hammer 14; and a power transmission mechanism 200, wherein the cylinder 10 is provided with a side cavity passage 17 in part of its outer wall, the side cavity passage 17 allowing one of outlet holes 90 of the jet element 9 to be in fluid communication with the lower cavity 16. In the impactor, the side cavity passage 17 is formed on the outer wall of the cylinder 10 in such a way that a substantially C-shaped groove closed to the inner wall surface of the outer sleeve is formed in the outer wall of the cylinder, that is, the side cavity passage 17 is sealingly isolated from the inner wall of the outer sleeve 2.

The power transmission mechanism comprises: an inner-prismy sleeve 5 with an inner hole having a polygonal profile, mounted inside an outer pipe 4 by connecting the male thread at the upper end of the inner-prismy sleeve 5 with the female thread at the lower end of the outer pipe 4; an outer-prismy anvil 6 with an outer polygonal profile mounted slidably in the inner hole of the inner-prismy sleeve 5; more than one fluid passages are provided at the top end of the outer-prismy anvil 6 so that the fluid passages are in communication with a hollow passage inside the outer-prismy anvil 6 and a hole is formed at the lower end of the anvil 6 with a female thread for matching with a male thread of a tool, in other words, the hole is in fluid communication with the hollow passage so that the drilling fluid can pass through said fluid passages and the hollow passage to the tool in the hole. The working efficiency is enhanced and the efficiency in transmitting impacting power due to the improvement on the primary seal.

According to another embodiment, there is provided a fluid-driven impactor comprising: an outer sleeve 2; a jet element 9 with a plurality of outlet holes 90; a cylinder 10; an upper fluid-diverging lid 8; a piston 11 located inside an inner cavity of the cylinder 10, which divides the inner cavity of the cylinder 10 into an upper cavity 15 and a lower cavity 16; a piston rod 12; a lower cylinder lid 13 with a hole at the center thereof; an impacting hammer 14; and a power transmission mechanism 200; wherein the cylinder 10 is provided with a side cavity passage 17 in part of its outer wall, the side cavity passage 17 allowing one of outlet holes 90 of the jet element 9 to be in fluid communication with the lower cavity 16. In the impactor, the side cavity passage 17 is formed on the outer wall of the cylinder 10 in such a way that a substantially C-shaped groove closed to the inner wall surface of the outer sleeve is formed in the outer wall of the cylinder, that is, the side cavity passage 17 is sealingly isolated from the inner wall of the outer sleeve 2. A nozzle 21 is removably mounted in one of fluid-diverging holes in the upper fluid-diverging lid 8 and the nozzle 21 is selected from a series of nozzles with various inner-diameters and made of a steel alloy whose HRC is at least about twice that of the upper fluid-diverging lid 8. Therefore, the life of the primary seal is extended and the nozzles are replaceable according to the fluid flow to enhance the working efficiency.

According to another embodiment of the present invention, there is provided a fluid-driven impactor, comprising: an outer sleeve 2; a jet element 9 with a plurality of outlet holes 90; a cylinder 10; an upper fluid-diverging lid 8; a piston 11 located inside an inner cavity of the cylinder 10; a piston rod 12; a lower cylinder lid 13 with a hole at the center thereof; an impacting hammer 14; and a power transmission mechanism 200. The power transmission mechanism comprises: an inner-prismy sleeve 5 with an inner hole having a polygonal profile, mounted inside an outer pipe 4 by connecting the male thread at the upper end of the inner-prismy sleeve 5 with the female thread at the lower end of the outer pipe 4; an outer-prismy anvil 6 mounted slidably in the inner hole of the inner-prismy sleeve 5; more than one fluid passages are provided at the top end of the outer-prismy anvil 6 so that the fluid passages are in communication with a hollow passage inside the outer-prismy anvil 6 and a hole is formed at the lower end of the anvil 6 with a female thread for matching with a male thread of a tool, in other words, the hole is in fluid communication with the hollow passage so that the drilling fluid can pass through said fluid passages and the hollow passage to the tool in the hole.

A nozzle 21 is removeably mounted in one of fluid-diverging holes in the upper fluid-diverging lid 8 and the nozzle 21 is selected from a series of nozzles with various inner diameters and made of a steel alloy whose HRC is at least about twice that of the upper fluid-diverging lid 8. Therefore, the life of the fluid-diverging hole is extended and the nozzles are replaceable according to the fluid flow to enhance the efficiency in transmitting the impacting energy the working efficiency.

According to another embodiment of the present invention, there is provided a fluid-driven impactor, comprising: an outer sleeve 2; a jet element 9 with a plurality of outlet holes 90; a cylinder 10; an upper fluid-diverging lid 8; a piston 11 located inside an inner cavity of the cylinder 10; a piston rod 12; a lower cylinder lid 13 with a hole at the center thereof; an impacting hammer 14; and a power transmission mechanism 200. The power transmission mechanism comprises: an inner-prismy sleeve 5 with an inner hole having a polygonal profile, mounted inside an outer pipe 4 by connecting the male thread at the upper end of the inner-prismy sleeve 5 with the female thread at the lower end of the outer pipe 4; an outer-prismy anvil 6 mounted slidably in the inner hole of the inner-prismy sleeve 5; more than one fluid passages are provided at the top end of the outer-prismy anvil 6 so that the fluid passages are in communication with a hollow passage inside the outer-prismy anvil 6 and a hole is formed at the lower end of the anvil 6 with a female thread for matching with a male thread of a tool, in other words, the hole is in fluid communication with the hollow passage so that the drilling fluid can pass through said fluid passages and the hollow passage to the tool in the hole.

A nozzle 21 is removeably mounted in one of fluid-diverging holes in the upper fluid-diverging lid 8 and the nozzle 21 is selected from a series of nozzles with various inner diameters and made of a steel alloy whose HRC is at least about twice that of the upper fluid-diverging lid 8.

In the impactor, the side cavity passage 17 is formed on the periphery of the cylinder 10 in such a way that a substantially C-shaped groove closed to the inner wall surface of the outer sleeve is formed in the outer wall of the cylinder, that is, the side cavity passage 17 is sealingly isolated from the inner wall of the outer sleeve 2. The life of both the primary seal and the fluid-diverging hole is therefore extended and the nozzles are replaceable according to the fluid flow to enhance the working efficiency.

In addition, according to the fifth aspect of the present invention, there is provided the use of the fluid-driven impactor. The impactor is used for drilling the rigid and fragile earth formation which has a rigidity of above 5, a compressive strength of 150 MPa and a rock drillability of above 5. As the fluid-driven jet-type impactor of the present invention has stronger impacting energy transmitting effects and longer working life for single application, it is particularly adapted to the formation as above described.

INDUSTRIAL APPLICABILITY

The fluid-driven impactor of the present invention is particularly adapted to be used in the fields such as petroleum. The power transmission mechanism of the present invention can be used with the jet-type impactor, the positive driven impactor, the negative driven impactor, the valve-type double driven impactor, jet and suction driven impactor and other impactors.

What is claimed is:

1. A fluid-driven impactor for petroleum drilling, comprising:

an outer sleeve;

a jet element mounted inside the outer sleeve and having a plurality of outlet holes;

a cylinder mounted inside the outer sleeve and having an inner cavity, the inner cavity of the cylinder being divided by a piston into an upper cavity and a lower cavity, wherein the cylinder is provided with a side cavity passage formed on the outer wall of the cylinder to bring one of the outlet holes of the jet element into communication with the lower cavity; and a sealing member mounted onto the outer wall of the cylinder to enclose the side cavity passage, thereby separating the side cavity passage from the inner wall of the outer sleeve in a fluidtight way.

2. The fluid-driven impactor as claimed in claim 1, characterized in that the side cavity passage is formed on the outer wall of the cylinder in such a way that a C-shaped groove is formed on the outer wall of the cylinder and the sealing member is sealed-by an arcuate metal piece welded onto the groove from outside, the contour of the metal piece matching with that of the groove.

3. The fluid-driven impactor as claimed in claim 1, characterized in that, the side cavity passage is at least partially formed in the outer wall of the cylinder, thereby the outer wall defines a portion of the side cavity passage.

4. The fluid-driven impactor as claimed in claim 1, characterized in that, a metal gasket for axial compressed sealing is provided between the jet element and an upper fluid-diverging lid of the cylinder.

5. The fluid-driven impactor as claimed in claim 1, characterized in that, a copper sleeve tightly surrounding a piston rod is set in a central hole of a lower cylinder lid of the cylinder.

6. The fluid-driven impactor as claimed in claim 1 further comprising a power transmission mechanism of the impactor, wherein the power transmission mechanism comprises:

an inner-prismy sleeve with an inner hole having a polygonal profile, mounted inside an outer pipe by connecting the male thread on an upper end of the inner-prismy sleeve with the female thread on a lower end of the outer pipe; and an outer-prismy anvil with an outer polygonal profile, mounted slidably in the inner hole of the inner prismy sleeve, wherein more than one fluid passages are provided at a top end of the anvil so that the fluid passages are in communication with a hollow passage inside the anvil, and a hole is formed at a lower end of the anvil with the female thread for matching with a male thread of a tool, so that the hole is in fluid communication with the hollow passage so that a drilling fluid can flow through said fluid passages and the hollow passage to the tool in the hole.

7. The fluid-driven impactor as claimed in claim 6, characterized in that, a nozzle is removably mounted in a fluid-diverging hole in the upper fluid-diverging lid, and the nozzle is selected from a series of nozzles with various inner diameters and made of a steel alloy which has a hardness of HRC>60.

8. The fluid-driven impactor as claimed in claim 1, characterized in that, a nozzle is removably mounted in a fluid-diverging hole in an upper fluid-diverging lid and the nozzle is selected from a series of nozzles with various inner diameters and made of steel alloy which has a hardness of HRC>60.

9. The fluid-driven impactor as claimed in claim 8, characterized in that, the nozzle is mounted in the fluid-diverging hole by means of a clip.

10. The fluid-driven impactor as claimed in claim 8, characterized in that, an outlet inner diameter H and an inlet inner diameter L of the nozzle is designed as follows: $0<H\leqq L$.

11. The fluid-driven impactor as claimed in claim 1 further comprises a power transmission mechanism, wherein the power transmission mechanism comprising:

an inner-prismy sleeve with an inner hole having a polygonal profile, mounted inside an outer pipe by connecting the upper end of the inner-prismy sleeve with the outer pipe; and an outer-prismy anvil with an outer polygonal profile, mounted slidably in the inner hole of the inner-prismy sleeve, more than one fluid passages being provided on a top end of the anvil so that the fluid passages are in communication with a hollow passage inside the anvil;

characterized in that, a hole is formed at a lower end of the outer-prismy anvil with a female thread for matching with a male thread of a tool, so that the hole is in fluid communication with the hollow passage so that a drilling fluid can flow through said fluid passages and the hollow passage to the tool mounted in the hole.

12. The fluid-driven impactor as claimed in claim 11, characterized in that, the top end of the outer-prismy anvil has a circular truncated conical form, and an upper part of the anvil with its outer surface adjacent to the top end has a hollow cylindrical form, and a lower part of the anvil is of a hollow body with an outer polygonal profile for engaging with the inner hole of the inner-prismy sleeve, and the hole is provided in a cylindrical lowermost part of the anvil, wherein the upper end of the inner-prismy sleeve is in threaded connection with the outer pipe.

13. The fluid-driven impactor as claimed in claim 12, characterized in that, the cross section of the inner-prismy sleeve and the cross section of the lower part of the outer-prismy anvil are of n-sided orthodox-polygon wherein n is from 3 to 10.

14. The fluid-driven impactor as claimed in claim 12, characterized in that, the conical uppermost part of the outer-prismy anvil has a slope of 25°-75° with respect to a transverse direction of the outer sleeve.

15. The an fluid-driven impactor as claimed in claim 12, characterized in that, the conical uppermost part of the outer-prismy anvil has a slope of 45°-75° with respect to a transverse direction of the outer sleeve and a ratio of the length of the inner hole of the inner-prismy sleeve to the diameter of the circumcircle of the polygon in the cross section of the inner-prismy sleeve is from 0.8 to 1.0.

16. The fluid-driven impactor as claimed in claim 11, characterized in that, an upper part of the outer-prismy anvil is provided with an open sleeve consisting of two semicircular clipping pieces, and the open sleeve is engaged with the outer pipe with a clearance.

17. The fluid-driven impactor as claimed in claim 16, characterized in that, an idle-running prevention mechanism is provided in such a way that a horizontal annular space is provided between the inner-prismy sleeve and the open sleeve, and axial displacement of the outer-prismy anvil is controlled by the inner-prismy sleeve so that the tool and the outer-prismy anvil automatically slide down along with an impacting hammer to stop the power supply and thereby to prevent the impacting hammer from impacting the outer-prismy anvil during idle operation.

18. The fluid-driven impactor as claimed in claim 11, characterized in that, a ratio of the length of the inner hole of the inner-prismy sleeve to the diameter of the circumcircle of the polygon in cross section of the inner-prismy sleeve is from 0.7 to 1.1.

19. The fluid-driven impactor as claimed in claim 11, characterized in that, the profile of the inner hole of the inner-prismy sleeve is of octagonal shape and the outer profile of the middle lower part of the outer-prismy anvil is of octagonal shape.

20. The fluid-driven impactor as claimed in claim 11, characterized in that, there are four fluid passages provided in the anvil.

21. The fluid-driven impactor as claimed in claim 11, characterized in that, a nozzle is removably mounted in one of a fluid-diverging holes in an upper fluid-diverging lid, and the nozzle is selected from a series of nozzles with various inner diameters and made of a steel alloy which has a hardness of HRC>60.

22. The fluid-driven impactor as claimed in claim 21, characterized in that, the nozzle is mounted in the fluid-diverging hole by means of a clip.

23. The fluid-driven impactor as claimed in claim 21, characterized in that, an outlet inner diameter H and an inlet inner diameter L of the nozzle is designed as follows: $0<H\leqq L$.

24. A fluid-driven impactor, comprising:

an outer sleeve;

a jet element mounted inside the outer sleeve and having a plurality of outlet holes;

an upper fluid-diverging lid with a plurality of fluid-diverging holes;

characterized in that, a nozzle is removably mounted in one of the fluid-diverging holes in the upper fluid-diverging lid, and the nozzle is selected from a series of nozzles with various inner diameters and made of a steel alloy which has a hardness of HRC>60.

25. The fluid-driven impactor as claimed in claim 24, characterized in that, the nozzle is mounted in the fluid-diverging hole by means of a clip.

26. The fluid-driven impactor as claimed in claim 24, characterized in that, an outlet inner diameter H and an inlet inner diameter L of the nozzle is designed as follows: $0<H\leqq L$.

* * * * *